US005312010A

United States Patent [19]

Johnson

[11] Patent Number: 5,312,010

[45] Date of Patent: May 17, 1994

[54] WIDE MOUTH CHILDPROOF CONTAINER

[75] Inventor: Gustav Johnson, Westfield, N.J.

[73] Assignee: Lermer Packaging Corp., Garwood, N.J.

[21] Appl. No.: 68,152

[22] Filed: May 28, 1993

[51] Int. Cl.[5] ..... B65D 41/16; B65D 55/02

[52] U.S. Cl. ..... 220/306; 215/223; 215/224

[58] Field of Search ..... 215/206, 209, 216, 223, 215/224; 220/260, 281, 306

[56] References Cited

U.S. PATENT DOCUMENTS 3,170,585 2/1965 O'Donnell ..... 215/224

4,406,376 9/1983 Berghahn ..... 215/224

*Primary Examiner*—Allan N. Shoap

*Assistant Examiner*—Nova Stucker

*Attorney, Agent, or Firm*—Charles E. Temko

[57] ABSTRACT

A wide mouth container or jar suitable for storage of viscous jells, such as hair dressings in which the closure includes provision for preventing unauthorized removal by children. To open the closure, it must be rotated to a predetermined location relative to the container to align a small radially extending tab opposite a corresponding gap in a radially extending flange on the outer surface of the container, following which the tab is pushed in a direction away from the flange to free to closure.

3 Claims, 1 Drawing Sheet

WIDE MOUTH CHILDPROOF CONTAINER

BACKGROUND OF THE INVENTION

This invention relates generally to the field of child proof containers, and more particularly to an improved type suitable for storage of relatively viscous fluids, such as hair dressing and the like, which is manually removed from the container by inserting the fingers of the user into the mouth of t container to adhere to the contents.

The problem of child proofing containers is well known in the container art, and many suitable closures have been developed. Most of the prior art is concerned with containers for medicinals in either liquid or tablet form, which require relatively small mouth containers enabling the contents to be removed by inverting the open container to permit a pouring operation. Most large mouth containers are used to store contents that are not readily available to children in the home, or in the case of packaged foods, for example, the contents are not particularly dangerous.

Many cosmetic preparations are conveniently packaged in collapsible tubes, for disbursing by squeezing the same. However, while such packaging is suitable for relatively safe products, such as toothpaste, a problem arises in the case of hairdressings and similar preparations, which may contain, in addition to the usual petroleum base, other ingredients such as hair straighteners and similar compositions which may be dangerous if ingested by children. Using teachings of the prior art, it is not readily possible to child proof collapsible tube type dispensers. Similarly, the prior art has no teachings for the child proofing of relatively wide mouth containers were the diameter of the mouth of the container is substantially similar to that of its diameter.

SUMMARY OF THE INVENTION

Briefly stated, the invention contemplates the provision of an improved wide mouth container suitable for storing relatively viscous fluids to which access is made by the user by inserting his fingers into direct contact with the contents, which incorporates a child proof accessibility. To this end, the disclosed embodiment incorporates a synthetic resinous container having a closure engaging rim by which a closure having a corresponding recess may be engaged in any rotational relationship relative to the mouth of the container, but which may be removed only upon the attainment of a particular rotational relation, at which time the closure may be flexed by the user to remove the same. Devices incorporating this type of interconnection are known in the art, and the invention lies in specific constructional details which tend to conceal from children the manner in which the container is readily removed. In a preferred embodiment, the alignment indicating means includes a small radially extending tab which is positioned by the user opposite a recess or gap in a corresponding radially extending flange on the outer surface of the container so that the user may exert pressure through the gap to contact the undersurface of the tab and urge the closure out of contact with the container. The outer diameter of the flange corresponds to the radial distance of the outer periphery of the tab, so that when the closure and container are such that the tab is misaligned with the gap, the tab itself is at least partially concealed. The novel construction has been tested for conformance with the Poison Prevention Packaging Act of 1970, Part 1700 of Title 16, Chapter II, subchapter E, published in the Federal Register, Volume 38, No. 151, of Aug. 7, 1973.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
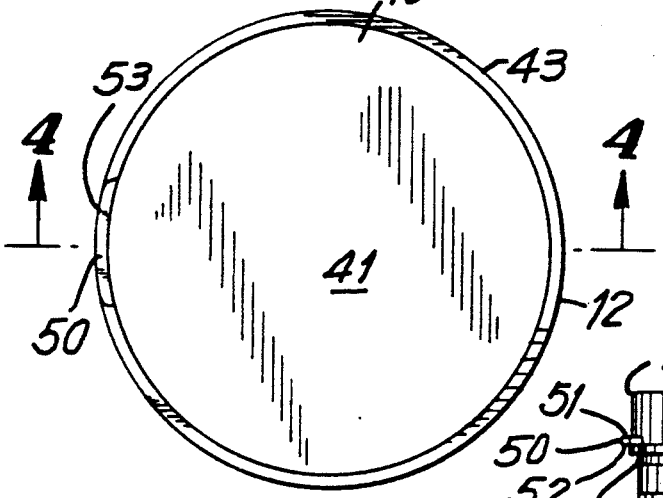
FIG. 1 is a top plan view of an embodiment of the invention.

In accordance with the invention, the device, generally indicated by reference character 10, comprises broadly, a container element 11 and a closure element 12.

The container element 11 may be formed of glass, but is most conveniently formed from molded synthetic resinous materials. to permit ready access to the contents, it is preferably of cylindrical configuration having a diameter of approximately 83 mm, the width of the open mouth corresponding to the diameter of the inner surface of the cylindrical side wall.

Figure 2:
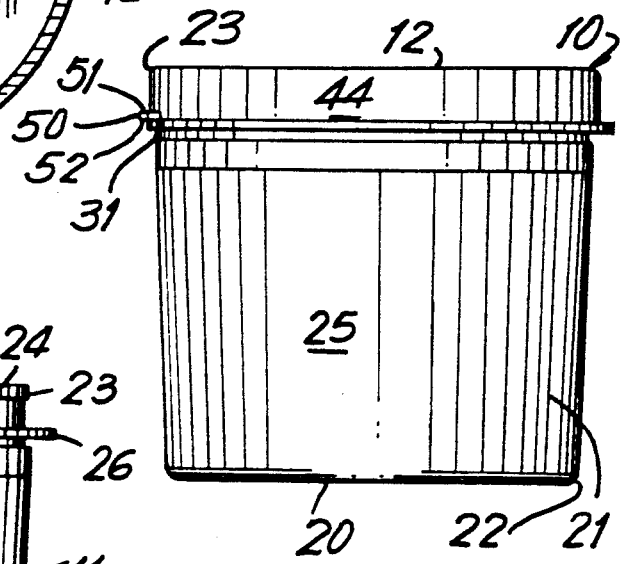
FIG. 2 is a side elevational view thereof.
Figure 3:
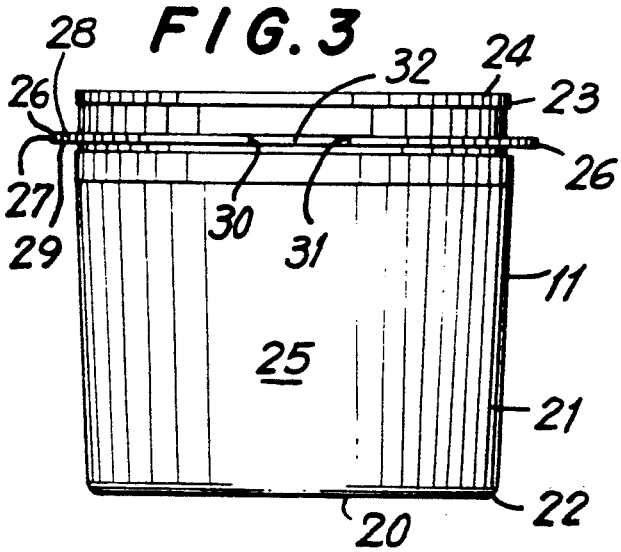
FIG. 3 is a side elevational view of a container element with a closure element removed.

Referring to FIGS. 2 and 3, the container element 11 includes a bottom wall 20 and a cylindrical side wall 21 extending from a lower edge 22 to an upper edge 23 bordering an open mouth 24. Disposed on the outer surface 25 of the wall 21 at a point a short distance below the mouth 24 is a radially extending flange 26 bounded by a peripheral edge surface 27 and upper and lower surfaces 28 and 29, respectively. Extending from point 30 to point 31 (FIG. 3) is a gap 32, the width of which is sufficient to permit entry of a finger of a user, and a depth of approximately half the depth of the flange 27. Bordering the mouth 24 is a closure retaining flange 34 having a tapered peripheral surface 35 which exerts a camming action upon the inner surface of the closure when it is pressed into engaged condition therewith. As contrasted with the corresponding container retaining flanges in the prior art, the flange 34 is uninterrupted.

Figure 4:
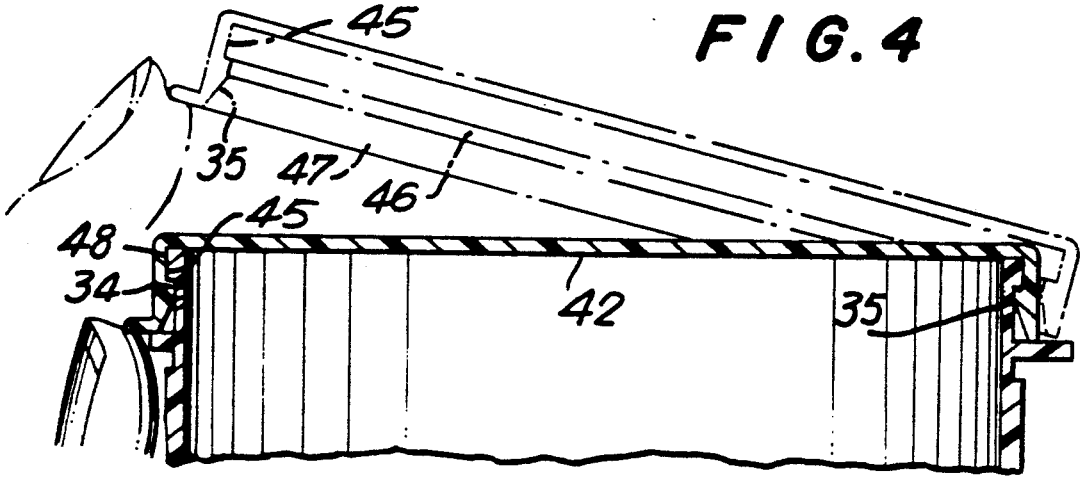
FIG. 4 is a vertical central sectional view of the closure element as seen from the plane 4—4 in FIG. 1.

The closure element 12 is of molded synthetic resinous construction, to allow a degree of flexibility greater than that of the container element 11. As best seen in FIGS. 1, 2, and 4, it includes an upper wall 40 having an outer surface 41 and an inner surface 42 which may support an optional sealing gasket (not shown). A cylindrical side wall 43 is bounded by an outer surface 44 and an inner surface 45 having an inwardly directed flange 46 which includes a tapered surface 47 corresponding to the surface 35 leading to a recess 48 in which the flange 34 is selectively seated. A radially extending tab 50 is bounded by an upper surface 51, a lower surface 52, and a peripheral surface 53 which, when the closure element is engaged, lies congruent with respect to the surface 27, as best seen in FIG. 1.

Because the closure element has a width of approximately 83 mm, it is considerably more flexible than the typical medicinal bottle closure, and accordingly, it is not necessary to provide a closure retaining bead having an interrupted segment to permit removal of the closure element in relatively unflexed condition as is necessary where the closure element is of smaller diameter. Instead, the closure may be removed with relatively little manual effort once the manner in which the container opening is appreciated. Thus, the novel structure lends itself ideally to convenient use by adults, while effectively discouraging the opening of the same by children of tender years. Since the tab 50 does not project beyond the flange 26, and the depth of the gap 32 is such as to present a surface which is congruent with the outer surface 74, unless the closure element is rotated to proper orientation with respect to the container element, there is no visible means for enabling a user to separate the closure element from the container element. Thus, the gap 32 may readily escape notice by a child, so that it will not readily occur to him to rotate the closure element.

The structure has been tested using a group of fifty children ranging in age from 42 months to 51 months. The children were each given one package and told to open it. Utilizing stop watches, the children were monitored for a five minute period. Upon completion of this five minute period, a visual demonstration was given (using a separate demonstration unit) showing the children how to open the package, with further instructions that they were allowed to use their teeth if they had not done so.

Of the fifty children tested, three were able to open the package during the first five minute period. During the second five minute period, an additional five children were able to open the package. Thus, the effectiveness, without instructing the children was ninety-four percent, and for the full ten minutes eighty-four percent, both being above the requirements of the Poison Prevention Packaging Act, above cited.

I wish it to be understood that I do not consider the invention to be limited to the precise details of structure shown and set forth in the specification, for obvious modification will occur to those skilled in the art to which the invention pertains.

I claim:

1. An improved child resistant wide mouth container comprising: a container element and a closure element; said container element including a bottom wall and a cylindrical side wall terminating at an upper edge thereof in an open mouth, said side wall having a radially extending closure-engaging flange bordering said mouth at an upper edge of said side wall, and a second radially extending flange positioned below said closure-engaging flange, said second flange being defined by a thickness between upper and lower generally planar surfaces, said second flange defining a gap in the periphery thereof; said closure element including an upper end wall and a cylindrical side wall, said side wall having an inner surface defining an annular recess in a cylindrical area adjacent said end wall selectively engaging said closure engaging flange, and an outer surface; a radially extending tab projecting from said outer surface, said second flange on said container element defining a peripheral edge surface, said radially extending tab being of substantially the same thickness as said second flange and having a peripheral edge surface lying in congruent relation therewith when said closure element is in engaged condition with said container element; whereby said closure element may be disengaged by rotation of said closure element relative to said container element to a position wherein said tab overlies said gap in said second flange to permit manual engagement of said tab.

2. The container in accordance with claim 1, in which said gap in said second flange is of a depth corresponding to the diameter of said side wall of said closure element to prevent access to a lower edge of said side wall through said gap.

3. The container in accordance with claim 1, in which said closure engaging flange is continuous, and said closure element is possessed of substantial flexibility to enable disengagement thereof from said closure engaging flange.

* * * * *